US007810899B2

(12) United States Patent
Usui et al.

(10) Patent No.: US 7,810,899 B2
(45) Date of Patent: Oct. 12, 2010

(54) INKJET PRINTER AND PRINTING HEAD CAPPING METHOD

(75) Inventors: Takamasa Usui, Ogaki (JP); Katsunori Nishida, Aichi-ken (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 852 days.

(21) Appl. No.: 11/644,093

(22) Filed: Dec. 22, 2006

(65) Prior Publication Data

US 2007/0165062 A1 Jul. 19, 2007

(30) Foreign Application Priority Data

Dec. 27, 2005 (JP) ..... 2005-375127
May 12, 2006 (JP) ..... 2006-134217

(51) Int. Cl.
*B41J 2/165* (2006.01)

(52) U.S. Cl. ..... 347/29

(58) Field of Classification Search ..... 347/29
See application file for complete search history.

(56) References Cited

U.S. PATENT DOCUMENTS 6,467,872 B1 10/2002 Yamada et al.
6,742,862 B2 6/2004 Yamada et al.
7,201,464 B2 * 4/2007 Sekiya ..... 347/29
7,237,868 B2 * 7/2007 Lim ..... 347/29
7,244,013 B2 * 7/2007 Harada et al. ..... 347/29
7,284,818 B2 * 10/2007 Yoshida et al. ..... 347/29
2006/0221120 A1 * 10/2006 Suzuki et al. ..... 347/29

FOREIGN PATENT DOCUMENTS

JP 2001/80087 3/2001

* cited by examiner

*Primary Examiner*—Julian D Huffman
*Assistant Examiner*—Jason S Uhlenhake
(74) *Attorney, Agent, or Firm*—Frommer Lawrence & Haug LLP

(57) ABSTRACT

An inkjet printer has a printing head having a nozzle surface on which a plurality of nozzles are located that spray a plurality of kinds of ink and a cap that covers the nozzle surface of the printing head. This cap includes a ring-shaped seal lip that is constructed so that the tip end thereof comes in contact with the nozzle surface to perform capping and a partitioning lip that partitions the area inside the seal lip into areas for nozzle groups that correspond to the kinds of ink. The tip end of either seal lip or partitioning lip is shaped so that it is compressed more easily than that of the other.

15 Claims, 12 Drawing Sheets

INKJET PRINTER AND PRINTING HEAD CAPPING METHOD

CROSS-REFERENCE TO RELATED APPLICATIONS

This Nonprovisional application claims priority under 35 U.S.C. §119(a) on Patent Applications No. 2005-375127 filed in Japan on Dec. 27, 2005, and No. 2006-134217 filed in Japan on May 12, 2006, the entire contents of which are hereby incorporated by reference.

BACKGROUND

This invention relates to an inkjet printer and a capping method for covering the nozzle surface of the printing head thereof, and more particularly, to an inkjet printer, which comprises a cap that is capable of maintaining an airtight seal even with a small cap load, and to the capping method for capping the printing head.

In the past, various shapes of caps to be used for capping the printing head of an inkjet printer have been proposed. For example, there is a cap having a protruding ring-shaped seal lip that is formed along the perimeter, and a partitioning lip that divides the inside of the ring-shaped seal lip corresponding to the nozzle groups (see Japanese Patent Application Laid Open No. 2001-80087).

However, when the cap load when covering the nozzle surface with the cap is large, various adverse effects may occur such as deformation of the precisely processed printing portion, for example deformation of the nozzle surface, head holder or the like, and so a small cap load is desired.

SUMMARY

However, in a cap having a partitioning lip inside a ring-shaped seal lip, as in the case of the cap described above, the total length of the lips that actually comes in contact with the nozzle surface when capping becomes long, so the cap load that acts on the nozzle surface becomes large. Furthermore, in the case of an inkjet printer for A3 sized paper, the number of nozzles is increased in order to increase the printing speed, and the nozzle surface of the printing head is formed to be large, so the size of the cap is also increased. Therefore, the total length of the lips that are formed in the cap also becomes long, and thus the cap load that acts on the nozzle surface increases. However, when the cap load is decreased so that the load that presses the cap against the printing head is weakened, there is a problem in that the load on the nozzle surface and head holder is reduced, so the seal between the nozzle surface and the tip ends of the lips is insufficient, and thus the seal made by the cap when capping the printing head decreases. Moreover, by increasing the rigidity of the printing head so that it can withstand the increasing cap load, the weight of the printing head increases, and thus disadvantages occur in that a motor having a large torque must be used for moving the carriage on which the printing head is mounted, design becomes complicated, and the amount of space required for the motor increases.

An object of the present invention is to provide an inkjet printer and printing-head capping method capable of maintaining the cap seal even when the cap load is small, and does not apply a large load on the nozzle surface, head holder, etc.

A first aspect is an inkjet printer, comprising: a printing head having a nozzle surface on which a plurality of nozzles are located that spray a plurality of kinds of ink; and a cap that covers the nozzle surface of the printing head; wherein the cap comprises a ring-shaped seal lip that is constructed so that the tip end thereof comes in contact with the nozzle surface to perform capping; and a partitioning lip that partitions the area inside the seal lip into areas for nozzle groups that correspond to the kinds of ink; and wherein the tip end of either the seal lip or partitioning lip is shaped so that it is compressed more easily than that of the other.

With this inkjet printer, the tip end of either the ring-shaped seal lip or the partitioning lip is deformed easily, and as a result, it becomes easy to absorb the load, so it is possible to reduce the cap load while maintaining a good seal in the cap. And it is possible to perform capping without applying a large load on the nozzle surface, head holder or the like.

A second aspect is an inkjet printer, comprising: a printing head having a nozzle surface on which a plurality of nozzles are located that spray a plurality of kinds of ink; and a cap that covers the nozzle surface of the printing head; wherein the cap comprises: a ring-shaped seal lip that is constructed so that the tip end thereof comes in contact with the nozzle surface to perform capping; and a partitioning lip that partitions the area inside the seal lip into areas for nozzle groups that correspond to the kinds of ink; and wherein the tip end of the seal lip protrudes more than the tip end of the partitioning lip.

With this inkjet printer, it is possible to cap the printing head by bringing just the tip end of the ring-shaped seal lip in contact with the nozzle surface, so it is possible to make the cap load small when storing the nozzles. Therefore, the nozzle surface and head holder are not damaged due to deformation or the like even when the nozzles are stored for a long time.

A third aspect is an inkjet printer, comprising: a printing head having a nozzle surface on which a plurality of nozzles are located that spray a plurality of kinds of ink; and a cap that covers the nozzle surface of the printing head; wherein the cap comprises: a ring-shaped seal lip that is constructed so that the tip end thereof comes in contact with the nozzle surface and cover all of the plurality of nozzles; and a partitioning lip that is located inside the seal lip, and that can separate nozzle groups that spray specified kinds of ink, and cover the nozzle groups; and wherein the cross-sectional shapes of the seal lip and the partitioning lip differ so that the loads that the nozzle surface receives from the seal lip and partitioning lip differ when capped.

With this inkjet printer, by changing the cross-sectional shapes of the seal lip and partitioning lip, for example, by changing the height and width, it is possible to change the contact load on the nozzle surface when capped. With this difference in contact load, it is possible to reduce the cap load when covering the printing head with the cap. Therefore, it is possible to reduce the load on the printing head when capped, and this is particularly effective when storing the nozzles when not printing, and when the printing head is capped for a long period of time such as when not using the printer. The partitioning lip may be located at plural positions.

A fourth aspect is a capping method for capping a printing head in which a cap covers a nozzle surface of a printing head on which a plurality of nozzles that spray a plurality of kinds of ink are located, comprising the steps of: moving the printing head to the position where the cap is located so that the printing head faces the cap; moving the cap toward the printing head; stopping movement of the cap when the tip end of a ring-shaped seal lip, which is formed in the cap, and the tip end of a partitioning lip, which partitions the inside of the seal lip for each kind of ink, come in contact with the nozzle surface when sucking ink from inside of the nozzles, and stopping the movement of the cap in a state where the tip end of the seal lip comes in contact with the nozzle surface, and the tip end of the partitioning lip does not come in contact with the nozzle surface, when storing the nozzles when not printing; and maintaining the cap in this stopped position.

With this method of capping a printing head, in addition to being able to perform purging for each kind of ink, the load acting on the nozzle surface when the nozzles are stored when not printing is mainly just from the ring-shaped seal lip, so when storing the nozzles, it is possible to cap the printing head with a small cap load. Therefore, when the nozzles are stored, the cap load becomes small and the load on the nozzle surface and head holder is reduced, so capping is possible in which damage to the nozzle surface and head holder due to deformation does not occur.

A fifth aspect is a capping method for capping a printing head when not printing in which a cap covers a nozzle surface of a printing head on which a plurality of nozzles that spray a plurality of kinds of ink are located, comprising the steps of: bringing the tip end of a ring-shaped partitioning lip that is located in the cap in contact with the nozzle surface, and covering a nozzle group that sprays an ink that becomes thicker more easily than other ink that is sprayed from the other nozzle groups with the partitioning lip; and bringing the tip end of a ring-shaped seal lip that is located around the partitioning lip in contact with the nozzle surface and covering all of the plurality of nozzles with the seal lip.

With this method of capping a printing head, the tip end of the partitioning lip comes in closer contact with the nozzle surface than the tip end of the seal lip, and the inside of the partitioning lip is covered by both the partitioning lip and seal lip, so it is possible to increase the seal inside the partitioning lip. Therefore, by covering a nozzle group that sprays ink that thickens easily and has low resistance to drying with the partitioning lip having a good seal, it is possible to perform capping in which the contact load between the seal lip and the nozzle surface is suppressed, so it is possible to reduce the cap load, and it is possible to reduce the load on the printing head when capped. This is particularly effective when storing the nozzles when not printing, and when the printing head is capped for a long period of time such as when not using the printer.

The above and further objects and features of the invention will more fully be apparent from the following detailed description with accompanying drawings.

DETAILED DESCRIPTION OF THE EXEMPLARY EMBODIMENTS

The preferred embodiments of the present invention will be described based on the drawings. The embodiments described below are just examples and needless to say it is possible to change the embodiments within a range that does not change the scope of the invention.

Figure 1:
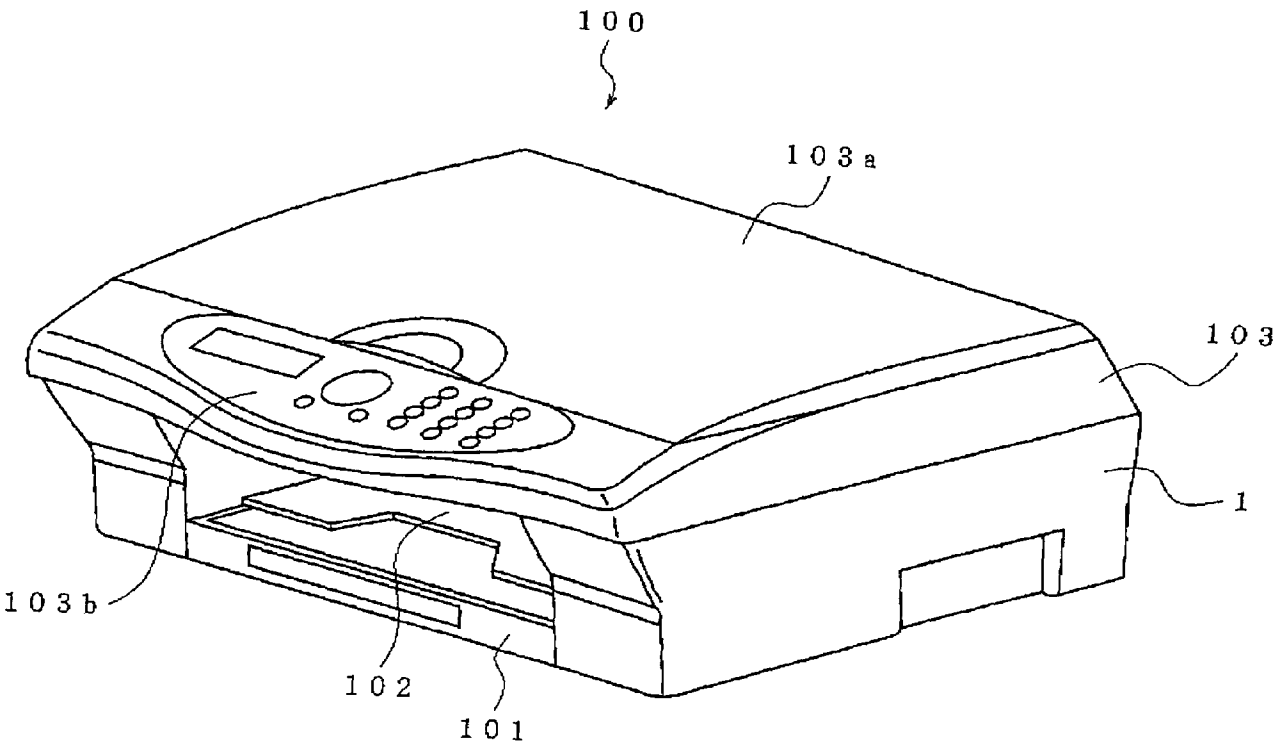
FIG. 1 is perspective drawing of an embodiment of a multi-function peripheral having an inkjet printer.

FIG. 1 is a perspective drawing of a thin-type multi-function peripheral 100 for A3-sized paper that, in addition to the function of the inkjet printer 1 of the present invention, has copy, scanning and facsimile functions. At the bottom of this multi-function peripheral 100 there is a paper-supply tray 101 that can be pulled out from the front, and the top cover of this paper-supply tray 101 is a paper-output tray 102 that receives the output paper. This multi-function peripheral 100 is a type of multi-function peripheral that supplies paper and outputs paper from the front. Also, at the top of the multi-function peripheral 100 there is a document-reading apparatus 103 that is used when making copies, reading images, or sending a facsimile, and on the underneath side thereof there is an inkjet printer 1.

Figure 2:
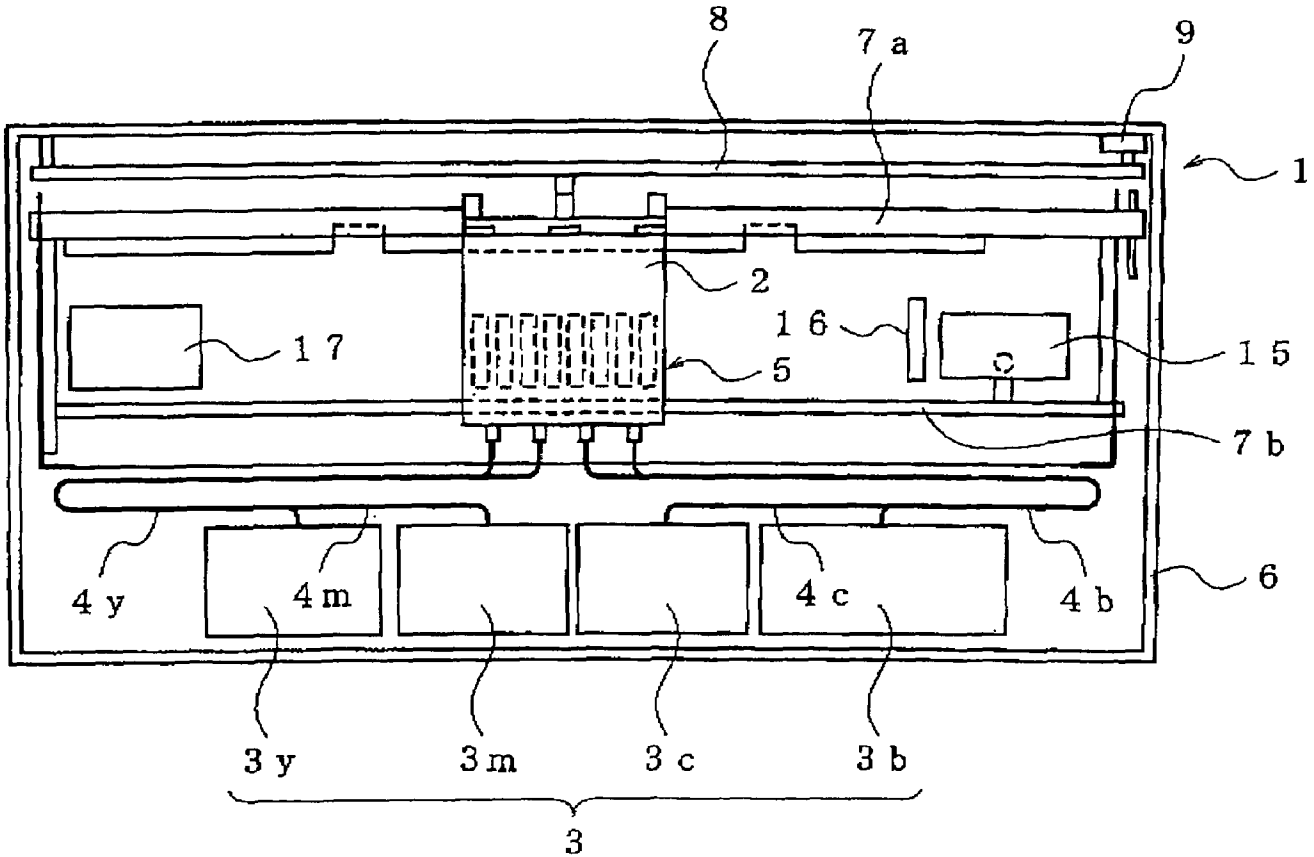
FIG. 2 is a top view of the inkjet printer.

On the top surface of the document-reading apparatus 103 there is a document-platen cover 103*a* that holds a document in place that has been set on the document platen, and an operation panel 103*b*. This document-reading apparatus 103 can be opened or closed with respect to the bottom section of the multi-function peripheral 100, which makes it possible to replace the ink cartridges of the inkjet printer 1. FIG. 2 is a simplified drawing showing the inside of the inkjet printer 1.

In FIG. 2, 2 is a printing-head unit that includes a printing head that sprays ink to print on the paper. Also, 3 indicates color ink cartridges for the colors black, magenta, cyan and yellow, where 3*b* is the ink cartridge for black, 3*m* is the ink cartridge for magenta, 3*c* is the ink cartridge for cyan and 3*y* is the ink cartridge for yellow.

The printing-head unit 2 is fastened to a carriage 5. This carriage 5 is flat in the width direction of a main case 6, and is installed to two parallel guide shafts 7*a*, 7*b* on the front and back front and back direction) so that it can freely move back and forth, and the carriage 5 is driven by a continuous timing belt 8 that is placed so that the lengthwise direction of the guide shafts 7*a*, 7*b* and rotational direction of the timing belt 8 are parallel. The timing belt 8 is driven by a drive motor 9 that is located on the end of the main case 6, and it can be driven in either the forward or reverse direction. This timing belt 8 drives the carriage 5, which moves the printing-head unit 2 that is attached to the carriage 5 to the right or left along the guide shafts 7*a*, 7*b*.

Figure 3:
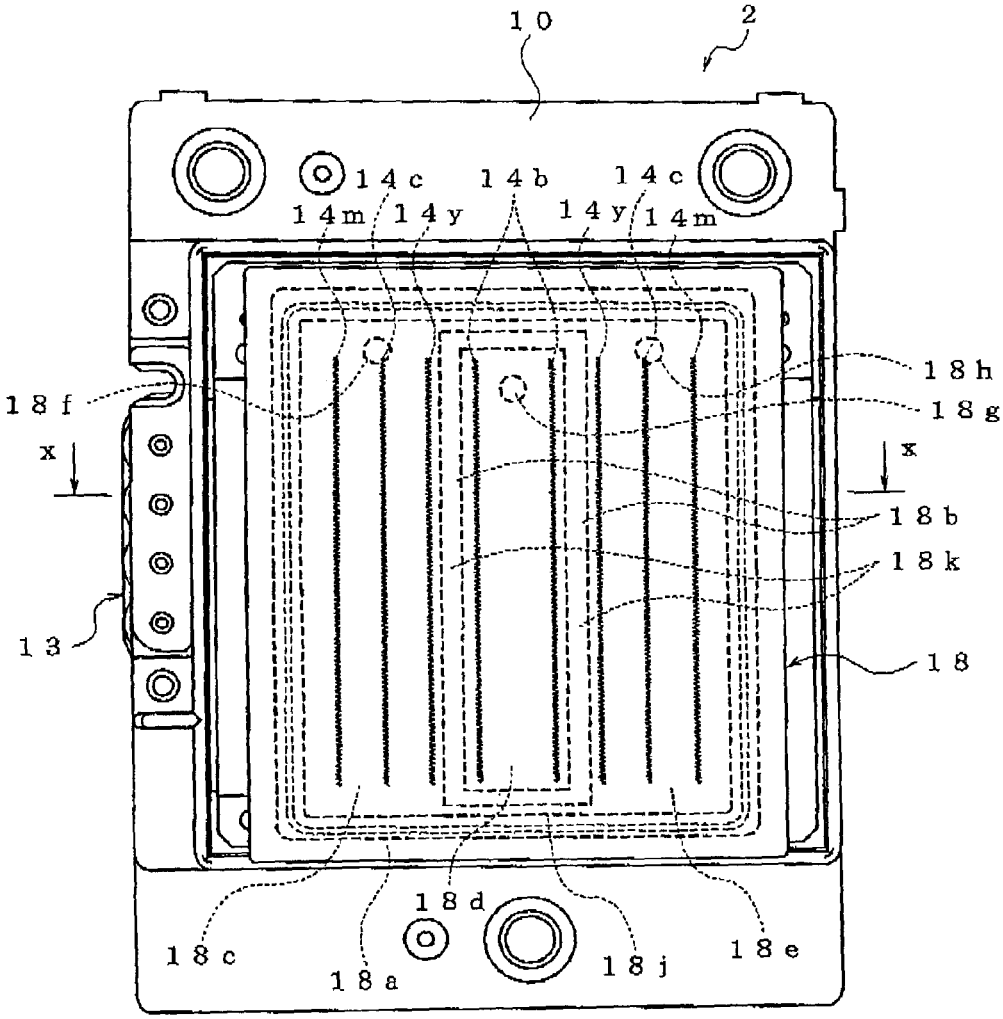
FIG. 3 is a drawing for explaining the positional relationship of the nozzle surface of the printing head and the cap of the inkjet printer.
Figure 4:
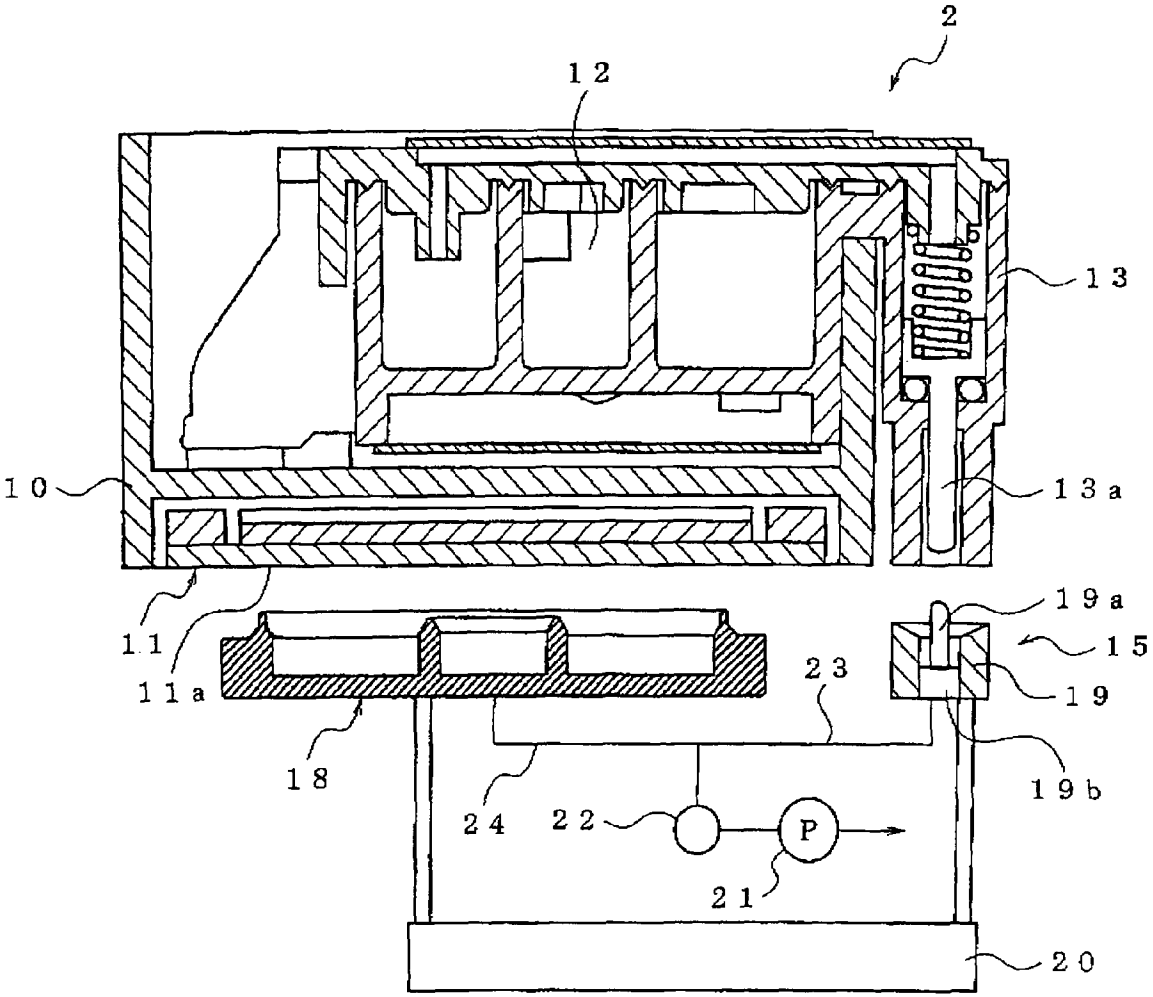
FIG. 4 is a drawing showing the placement relationship of the printing head and maintenance unit of the inkjet printer.

As shown in the bottom view of FIG. 3 and the cross-sectional view of FIG. 4, in the printing-head unit 2 that is fastened to the carriage 5, there is a printing head 11 that is located on the bottom section of a box-shaped head holder 10, and there is a buffer tank 12 and an exhaust means 13 located on the top side of the printing head 11. The bottom surface of the head holder 10 is open, and the underneath surface of the printing head 11 is exposed.

The underneath surface of the printing head 11 is a nozzle surface 11*a*, and nozzle groups that spray each color of ink, or in other words, black ink, yellow ink, cyan ink and magenta ink, are located on the nozzle surface 11*a*. Each nozzle group is arranged so that a plurality of nozzles are arranged in the direction orthogonal to the direction of movement of the printing-head unit 2. The two rows of nozzle group 14*b* for black ink are located in the center, and the nozzle groups for color ink are arranged symmetrically on both sides of it on the left and right, and arranged in order starting from the nearest to the nozzle group 14*b* for black ink as, the nozzle group 14*y* for yellow, the nozzle group 14*c* for cyan and the nozzle group 14*m* for magenta.

On the other hand, on the bottom section of the main case 6, on one end in the width direction, there is a maintenance unit 15 so that the guide shafts 7*a*, 7*b* are positioned between the projected image that is projected downward. On the side of this maintenance unit 15 there is a wiper 16 that wipes and cleans the nozzle surface 11*a* of the printing head 11. On the end opposite from the maintenance unit 15 there is an ink-receiving unit 17, and it is such that it can collect ink that is sprayed from the nozzle during flashing (see FIG. 2).

Next, the maintenance unit 15 will be explained with reference to FIG. 4. The maintenance unit 15 comprises a cap 18 made of an elastic material for covering the nozzle surface 11*a* of the printing head 11, and an exhaust cap 19 for sucking out air bubbles that have accumulated in the exhaust means 13. These caps 18, 19 can be selectively raised or lowered by a common raising/lowering means 20, and they are connected to one suction pump 21 by way of one switching valve 22. On the exhaust cap 19 there is a release rod 19*a*, which protrudes upward and is able to push up a valve rod 13*a* of the exhaust means 13 to open the exhaust means 13, and a suction port 19*b*, which sucks air bubbles from the opened exhaust means 13. This suction port 19*b* and switching valve 22 are connected by a suction tube 23.

Figure 5A:
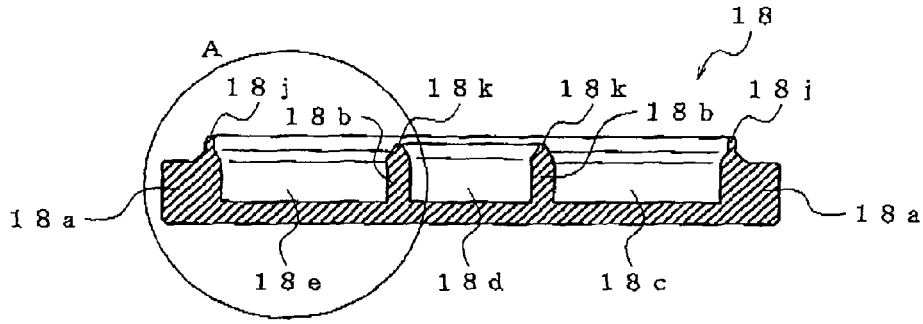
FIG. 5A is a cross-sectional view as seen from the direction x-x of FIG. 3.
Figure 5B:
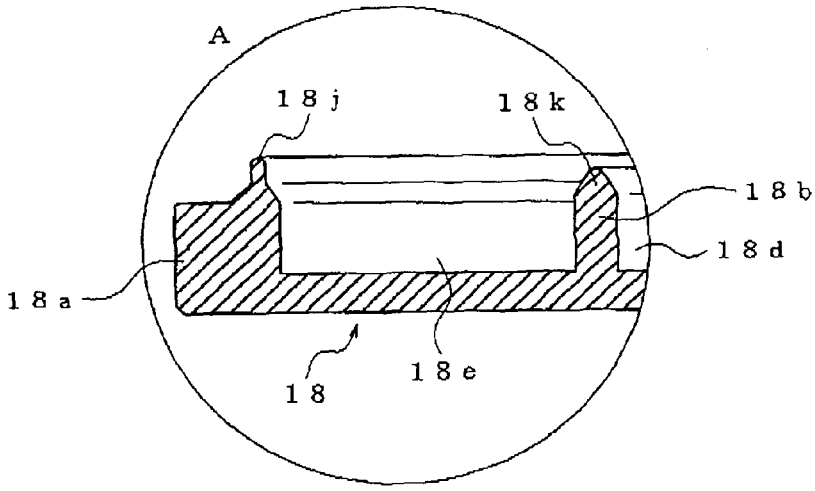
FIG. 5B is an enlarged view of area A in FIG. 5A.

On the other hand, the cap 10 that covers the nozzle surface 11*a* of the printing head 11 is formed into a long rectangular shape that is long in the direction of placement of the nozzles as seen from the top (see FIG. 3). As shown in FIG. 5A and FIG. 5B, on this cap 18 there is a protruding ring shaped seal lip 18*a* that is formed along the edge. Also, on the inside of the ring-shaped seal lip 18*a* there is a protruding ring-shaped partitioning lip 18*b* that is formed in a rectangular shape that is long in the same direction as the lengthwise direction of the cap 18 and it surrounds the center section of the inner surface of the cap 18.

On the inner surface of the cap 18, there is a chamber 18*d* formed on the inside of the partitioning lip 18*b* that corresponds with the two-row nozzle group 14*b* that sprays black ink. On both sides of the chamber 18*d*, there are chambers 18*c*, 18*e* that are formed between the inside surface of the ring-shaped seal lip 18*a* and the outside surface of the ring shaped partitioning lip 18*b*, so that they correspond with the nozzle groups 14*y*, 14*m*, 14*c* for color ink that are located on both sides of the nozzle group 14*b*. There is a gap formed between the inside surface of the ring-shaped seal lip 18*a* and the outside surface of the ring-shaped partitioning lip 18*b*, so the chambers 18*c* and 18*e* are connected together. Also, on the ends of each of the chambers 18*c* to 18*e* there are suction ports 18*f* to 18*h* that connect to one end section of the suction tube 24 whose other end is connected to the switching valve 22.

The seal lip 18*a* is higher than the partitioning lip 18*b*, and the tip end of the seal lip 18*a* protrudes out further than the tip end of the partitioning lip 18*b*. The tip-end section 18*k* of the partitioning lip 18*b* is formed so that the thickness becomes gradually thinner toward the tip end, and it has a triangular cross-sectional shape with a rounded tip end. Also, the tip end section 18*j* of the seal lip 18*a* is formed so that it is nearly the same thickness from the base to the tip end, and similarly the tip end is rounded. Also, by making the thickness of the tip end section 18*j* of the seal lip 18*a* thin, it is more easily compressed than the tip end section 18*k* of the partitioning lip 18*a*. The height of the tip end section 18*j* is set so that it is greater than the height difference between the ring shaped seal lip 18*a* and partitioning lip 18*b*.

This cap 18 covers the nozzle surface 11*a* of the printing head 11, performs purging to suck out the ink from the nozzles on the nozzle surface 11*a*, and stores the nozzles when not printing. When performing purging, the switching valve 22 switches to the position where the cap 18 and suction pump 21 are connected through to each other, and a vacuum is created inside the cap 18 by the suction pump 21. Also, when storing the nozzles, the switching valve 22 or suction pump 21 is stopped at a position so that the suction ports 18*f* to 18*h* of the cap 18 are not connected through to the outside, and when the cap 18 is in contact with the nozzle surface 11*a*, a sealed space is formed inside the cap 18. Especially, when storing the nozzles, only the tip end of the seal lip 18*a* needs to come in contact with the nozzle surface 11*a*, and since the tip end section 18*j* of the seal lip 18*a* is compressed and deformed easily, it is possible to perform capping with a good seal and small cap load.

The suction ports 18*f* to 18*h* are formed in all of the chambers 18*c* to 18*e* inside the cap 18, however, since the chamber 18*c* and chamber 18*e* are connected through to each other, it is possible to form a suction port in just one. Also, the partitioning lip 18*b* is ring-shaped, however, it is also possible to connect the portions of the ring-shaped seal lip 18*b* facing each other.

Figure 6:
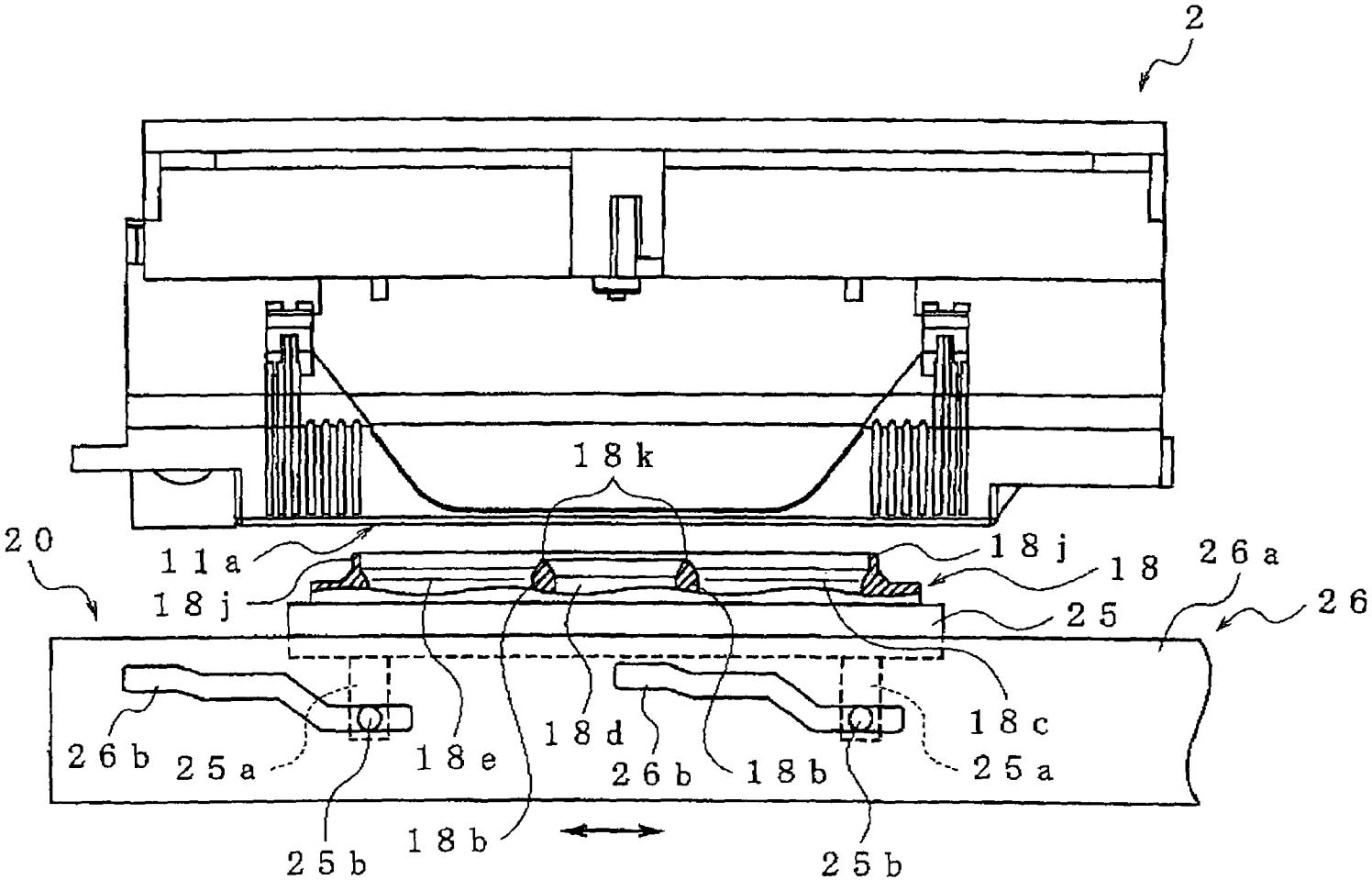
FIG. 6 is a drawing showing the capping method for capping a printing head (state before capping)
Figure 7A:
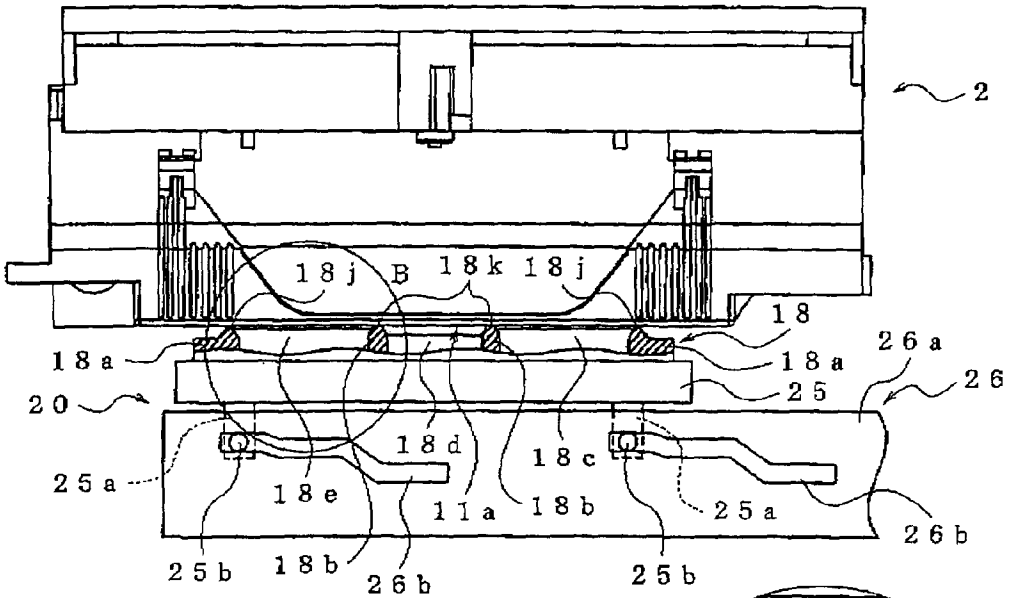
FIG. 7A is a drawing showing the capping method for capping a printing head (capping state when purging)

Next, the method for capping the printing head 11 with the cap 18 will be explained with reference to FIGS. 6 to 8. In FIGS. 6 to 8, a cut out part of the cap 18 is shown.

FIG. 6 shows the portion of the raising/lowering means 20 of the cap 18 in more detail. In FIG. 6, 25 is a support platform that supports the cap 18 from the underneath side and that raising and lowering the cap 18, and 26 is a slider cam that can move back-and-forth in the same direction as the direction of movement of the printing-head unit 2, and by this back-and-forth movement is capable of raising or lowering the support platform 25. The cap 18 is located on the top surface of the support platform 25, and on the bottom surface of the support platform 25 is a pair of cylindrical-shaped follower cylinders 25*a* that protrude downward so that they are lined up with the direction of movement of the slider cam 26. A pair of follower pins 25*b* are located at opposite locations on the outer surfaces of the follower cylinders 25*a* and protrude in the radial direction of the follower cylinders 25*a*.

On the other hand, the slider cam 26 comprises a pair of guide pieces 26*a* that are parallel with the direction of movement of the printing-head unit 2, and guide holes 26*b* that guide the follower pins 25*b* of the support platform 25 are formed in the guide pieces 26*a* with one for each follower cylinder 25*a*. The guide holes 26*b* have three horizontal sections in the top section, middle section and bottom section of the guide pieces 26*a* that are shifted in one direction of the back-and-forth direction of the slider cam 26, and have two inclined sections between the ends of each of the adjacent horizontal sections that connect the horizontal sections into one continuous hole, so that they can switch the position of the support platform 25 among three levels, a top level, middle level and bottom level. The guide holes 26*b* that are formed in this way are symmetrically located in the pair of guide pieces 26*a*. These pairs of guide holes 26*b* are such that the pair of follower pins 25*b* of the follower cylinders 25*a* can be inserted in them. The support platform 25 is constantly being pushed upward by springs (not shown in the figure), and the follower cylinders 25*a* are restricted by guide members (not shown in the figure) so that they can only move in the up/down direction.

When not performing capping, this raising/lowering means 20 moves the slider cam 26 to a position where the cap 18 is lowered, or in other words, to a position where the follower pins 25*b* of the support platform 25 are held in the bottom horizontal section of the guide holes 26*a* (see FIG. 6).

Also, as shown in FIG. 6, when performing purging, the timing belt 8 is driven with the cap 18 in the lowered state, and moves the carriage 5 toward the top of the maintenance unit 15 so that the cap 18 faces the nozzle surface 11*a* of the printing head 11. After that, by sliding the slider cam 26, the follower pins 25*b* that are inserted into the guide holes 26*b* are moved to the top horizontal section of the guide holes 26*b*. By doing that, the support platform 25 is raised and the tip end of the seal lip 18*a* and the tip end of the partitioning lip 18*b* of the cap 18 come in close contact with the nozzle surface 11*a* (see FIG. 7A). In this way, the printing head 11 is capped and purging is performed.

When purging by the chambers 18*c* to 18*e* of the cap 18, the nozzle surface 11*a* of the printing head 11 is separated according to type of ink that is sucked from the nozzles, or in other words, the group of nozzles 14*b* that spray black ink, and the groups of nozzles 14*y*, 14*m* and 14*c* that spray color ink are separated and sealed respectively. Therefore, it is possible to separately suck out the black ink and color ink. In this case, when either the black ink or the color ink is pigment ink, and the other is dye ink, the nozzles may become plugged up if both kinds of ink were allowed to mix and accumulate together inside the cap 18, however, by sucking out the ink separately as described above, it is possible to avoid plugging up the nozzles.

Figure 7B:
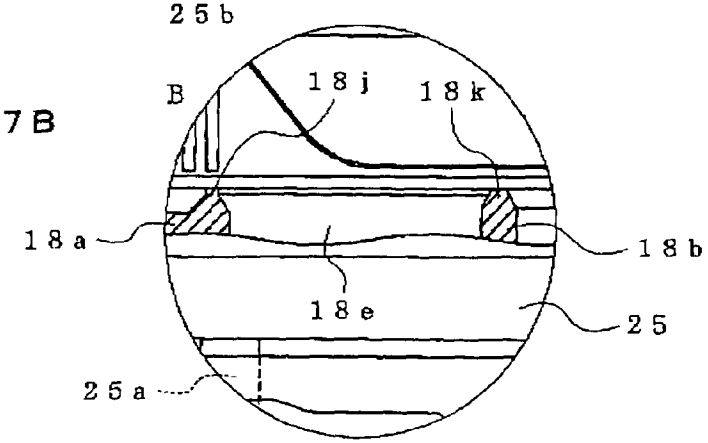
FIG. 7B is an enlarged view of part B in FIG. 7A.

Moreover, as shown in FIG. 7B, the tip end section 18*j* of the seal lip 18*a* is compressed and deformed, and the load that acts on the nozzle surface 11*a* from the seal lip 18*a* is absorbed by this deformation of the tip end section 18*j*. As a result, the cap load that acts on the nozzle surface 11*a* is reduced, and the load on the nozzle surface 11*a* and head holder 10 that accompanies this capping is reduced.

Nest, capping when storing the nozzles of the nozzle surface 11*a* when not printing will be explained. The capping method up to the point of performing purging by facing the cap 18 toward the nozzle surface 11*a* of the printing head 11 is the same and so is omitted.

Figure 8A:
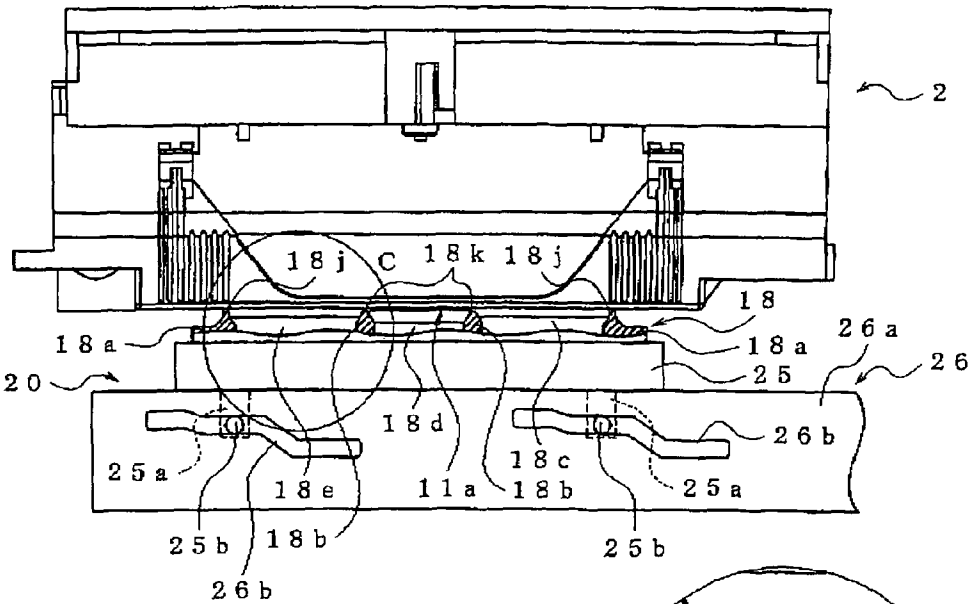
FIG. 8A is a drawing showing the capping method for capping a printing head (capping state when storing)
Figure 8B:
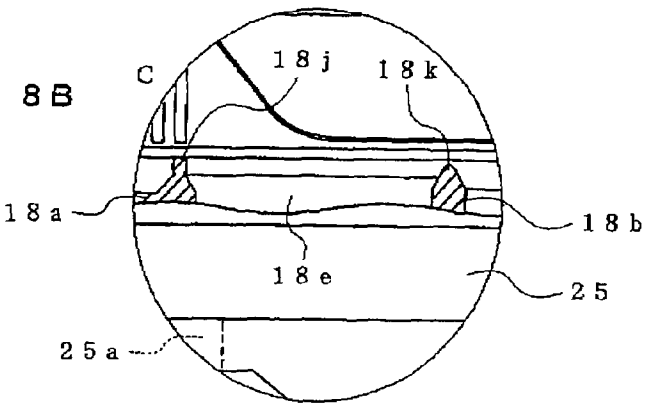
FIG. 8B is an enlarged view of part C in FIG. 8A.

After facing the cap 18 toward the nozzle surface 11*a* of the printing head 11, the slider cam 26 is moved, which moves the follower pins 25*b* from the bottom horizontal section to the middle horizontal section of the guide holes 26*a*, and the slider cam 26 is stopped. When doing that, the cap 18 is raised, and as shown in FIGS. 8A and 8B, only the tip end of the seal lip 18*a* comes in contact with the nozzle surface 11*a*. On the other hand, the tip end of the partitioning hip 18*b* is separated from the nozzle surface 11*a*. When doing this, it is also possible to have the tip end of the partitioning lip 18*b* come in light contact with the nozzle surface 11*a* so that no load is applied to the nozzle surface 11*a*.

Therefore, since there is no load from the partitioning lip 18*b* on the nozzle surface 11*a*, the cap load is decreased. Also, the tip end section 18*j* of the seal lip 18*a* is easily deformed, which keeps the load acting on the nozzle surface 11*a* low, so there is a capped state with no load being applied to the nozzle surface 11*a* and head holder 10.

As described above, the entire length of the ring-shaped seal lip 18*a* is longer than that of the partitioning lip 18*b*, and as a result the seal lip 18*a* applies a larger load on the nozzle surface 11*a* than the partitioning lip 18*b*, so by forming the tip end of the seal lip 18*a* so that it is easily compressed, it is possible to reduce the capping load when performing capping. Therefore, since it is possible to further reduce the cap load during capping, it is possible to perform capping that will not damage the nozzle surface 11*a* or head holder 10 due to deformation or the like.

Also, the shape of the tip end of the seal lip 18*a* is formed so that the thickness is thin and easily compressed, and the tip end section 18*j* of the seal lip 18*a* can be made using simple construction so that it is easily deformable. Therefore, the shape of the cap 18 is not complex and can be easily manufactured, and as a result, parts can be easily procured.

Moreover, the partitioning lip 18*b* is located inside the ring-shaped seal lip 18*a* in a ring shape, and a gap is formed between the partitioning lip 18*b* and seal lip 18*a*, the portion inside the ring-shaped seal lip 18*a* and outside the partitioning lip 18*b* is connected, so ink that is received in the portion outside the partitioning lip 18*b* can be discharged out of the cap 18 from a suction port in one location. Therefore, together with being possible to reduce the number of suction ports that are formed in the cap 18 and simplify the construction of the cap 18, it is possible to omit a discharge means such as a tube for discharging the ink that is received in the cap 18, which makes it possible to simplify the internal construction of the printer.

Figure 9A:
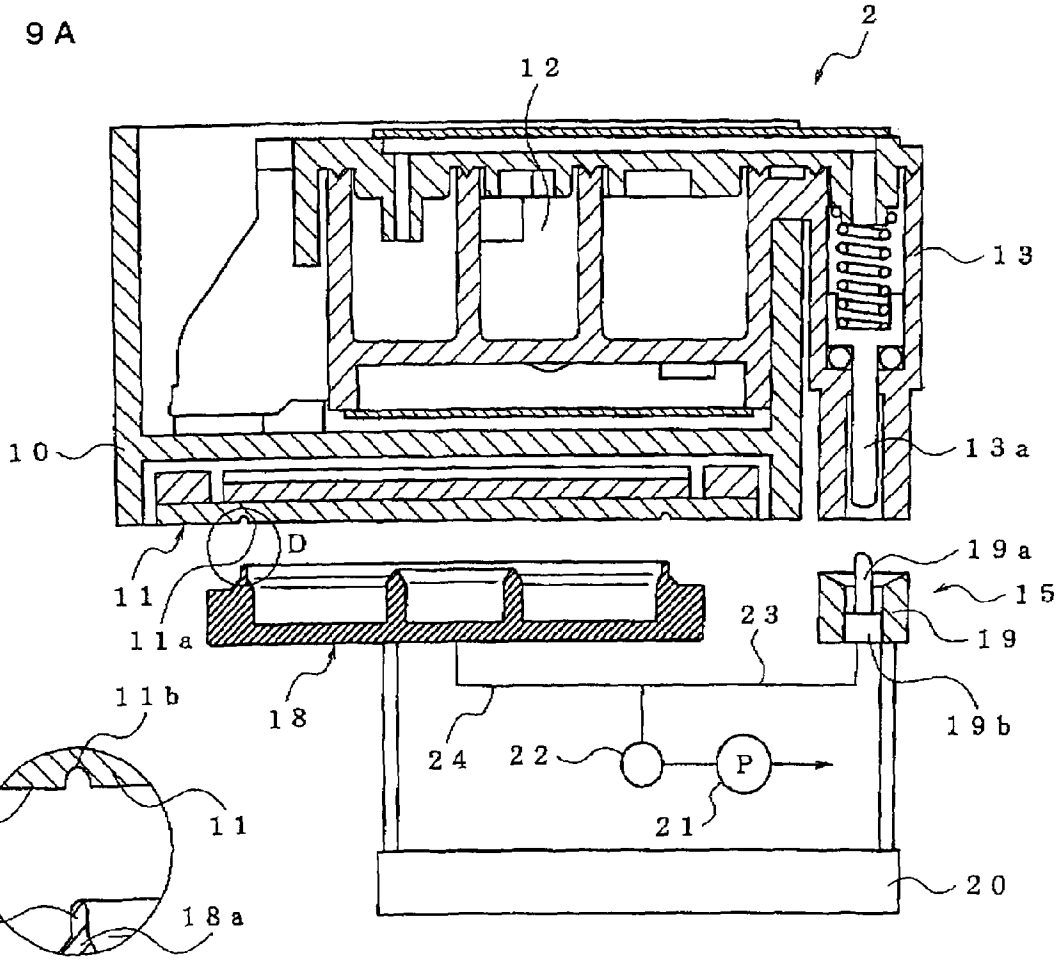
FIG. 9A is a drawing showing another capping method.
Figure 9B:
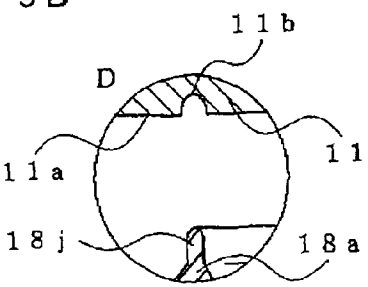
FIG. 9B is an enlarged view of part D in FIG. 9A.

As shown in FIG. 9B, when a depressions 11*b* that corresponds to the tip end section 18*j* of the seal lip 18*a* is formed in the nozzle surface 11*a*, it is possible to reduce the amount of compression (deformation) of the tip end section 18*j* when the seal lip 18*a* is brought into contact with the nozzle surface 11*a*. As a result, the load from the seal lip 18*a* acting on the nozzle surface 11*a* is reduced, and thus it is possible to reduce the cap load when purging. In addition, it is possible to reduce the load on the lips. Also, when performing capping by bringing both the seal lip 18*a* and the partitioning lip 18*b* in contact with the nozzle surface 11*a*, the load acting on the nozzle surface 11*a* from the seal lip 18*a* is reduced, so it is possible to suppress the cap load. Moreover, together with being able to increase the life of the tip end of seal lip 18*a*, it is possible to perform purging with no load on the nozzle surface 11*a* and head holder 10.

Figure 10A:
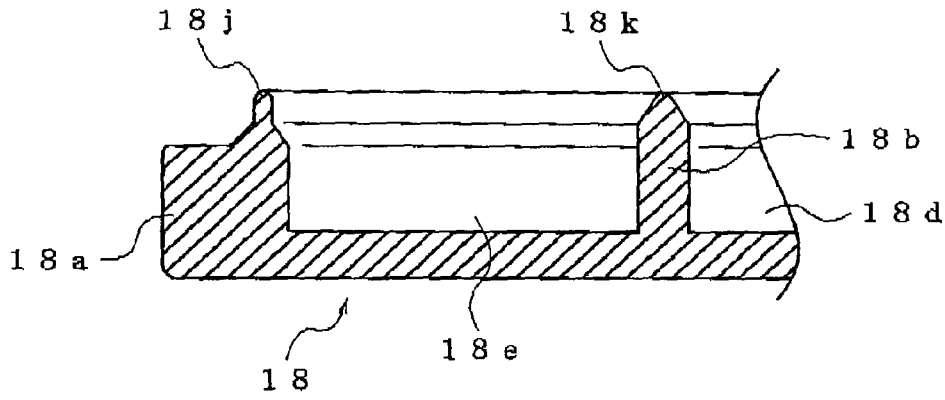
FIG. 10A is an enlarged view of a cap that is formed so that the height of the seal lip and partitioning lip is the same, and so that the tip end section of the seal lip is easily compressed.
Figure 10B:
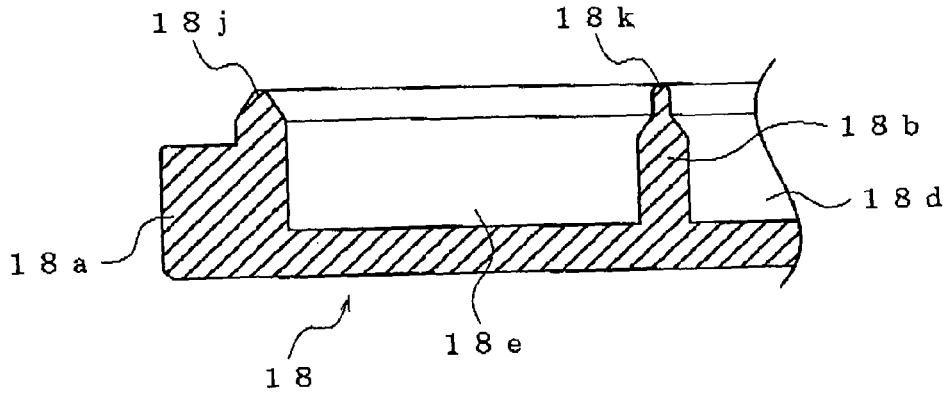
FIG. 10B is an enlarged view of a cap that is formed so that the height of the seal lip and partitioning lip is the same, and so that the tip end section of the partitioning lip is easily compressed.

Besides the shape of the cap 18 of the embodiment described above, the following shapes could also be used. The cap 18 shown in FIG. 10A is a cap in which the height of the seal lip 18*a* and the partitioning lip 18*b* is the same, and the cap 18 shown in FIG. 10B is a cap in which the shape of the tip end of the seal lip 18*a* and that of the partitioning lip 18*b* have been switched with each other.

In these caps 18, the tip end section 18*j* of the seal lip 18*a* or the tip end section 18*k* of the partitioning lip 18*b* is easily compressed, so capping is possible with a small cap load and without losing any seal. Particularly, as shown in FIG. 10A, the entire length of the seal lip 18*a* is longer than that of the partitioning lip 18*b* and as a result the seal lip 18*a* applies a larger load on the nozzle surface 11*a* than the partitioning lip 18*b*, so by forming the tip end of the seal lip 18*a* so that it is compressed easily, it becomes possible to perform capping with even a smaller cap load.

Figure 11A:
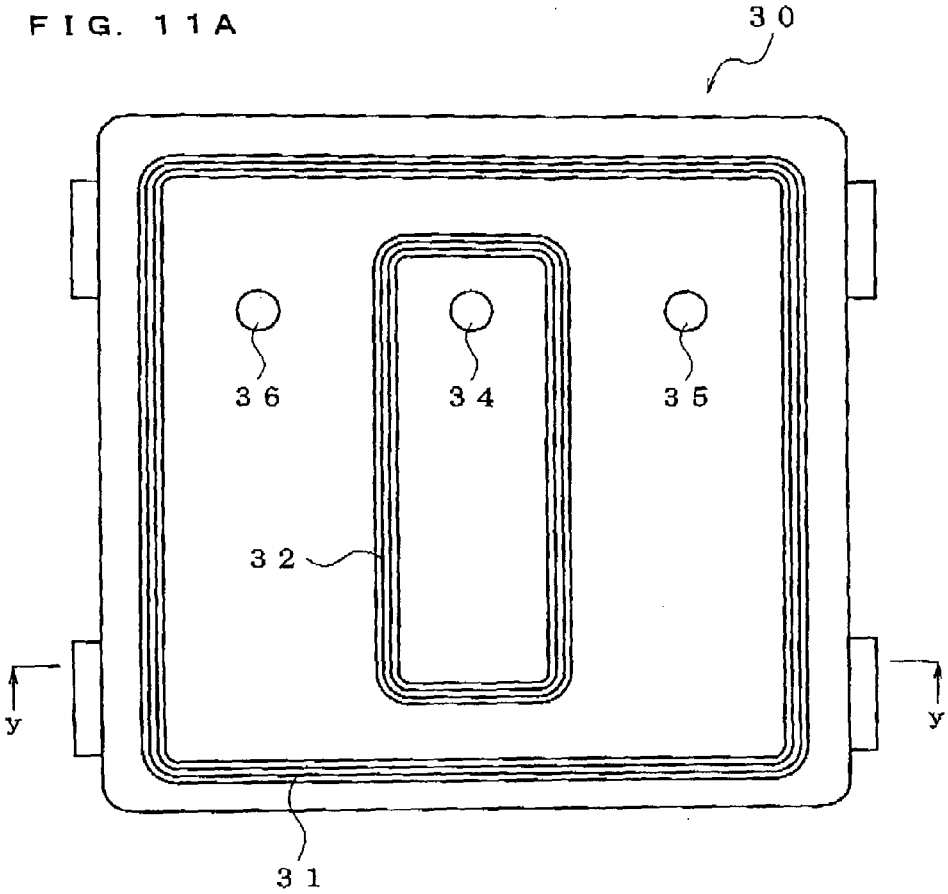
FIG. 11A is a top view of a variation of a cap.
Figure 11B:
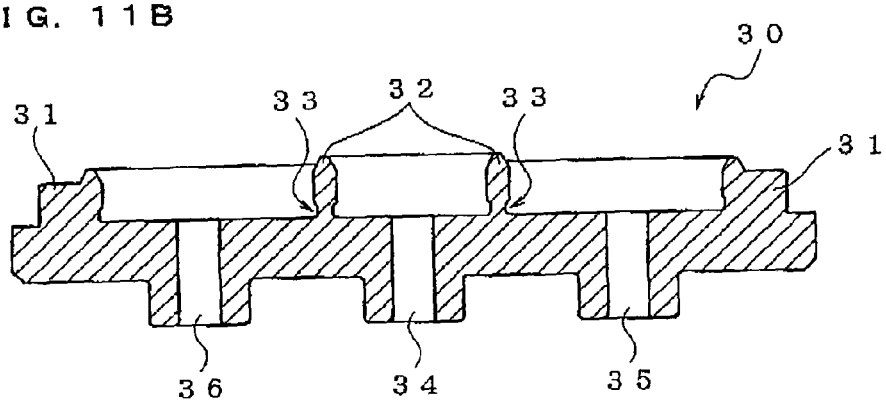
FIG. 11B is a cross-sectional view as seen from the direction y-y in FIG. 11A.

Furthermore, another variation of a cap is shown in FIGS. 11A and 11B. This cap 30 is a cap that can be used for the purging process and for storing the nozzles when not printing, and it is made using elastic material that is formed into a square shape as shown in the top view of FIG. 11A. Also, a seal lip 31 is formed on the top surface of the cap 30 so that it is protrudently ring-shaped along the outer perimeter of the cap 30, and on the inside of the seal lip 31 there is a protruding ring-shaped partitioning lip 32 (see FIG. 11B). The partitioning lip 32 is formed in a long rectangular shape that is long in the direction of arrangement of the nozzle groups that are located on the nozzle surface of the printing head.

The seal lip 31 is of a size such that it is capable of covering all of a plurality of nozzle groups on the nozzle surface of the printing head, and the partitioning lip 32 is of a size such that it is capable of covering a nozzle group that sprays a specified ink. Also, the seal lip 31 and partitioning lip 32 are formed so that the tip end of the partitioning lip 32 protrudes out more than the tip end of the seal lip 31. The tip end sections of the lips 31, 32 are formed so that the inside and outside surfaces are inclined and so that they have a triangular cross section. Also, the thickness at the bottom section of the partitioning lip 32 becomes thin, forming a neck section 33.

Moreover, an ink-discharge port 34 is formed in the cap 30 so that it penetrates from top to bottom of the cap 30 and is located within the partitioning lip 32 at a position near one side in the lengthwise direction. Similar ink-discharge ports 35, 36 are on both sides of the partitioning lip 32 between the partitioning lip 32 and seal lip 31, and are located so that they are inline horizontally with the ink-discharge port 34.

Figure 12A:
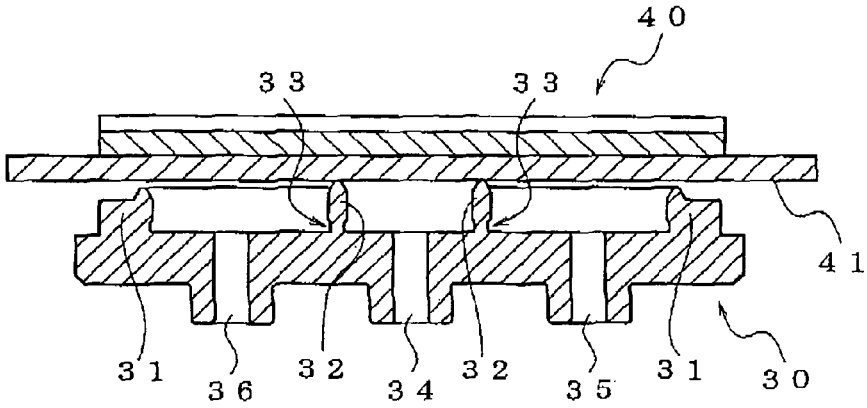
FIG. 12A is a cross-sectional view showing the capping method for a printing head for a variation of the cap (state where the tip end of the partitioning lip is in contact with the nozzle surface)
Figure 12B:
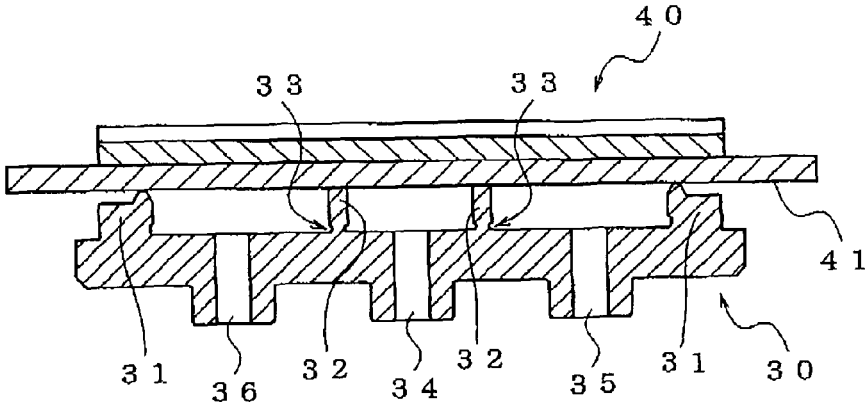
FIG. 12B is a cross-sectional view showing the capping method for a printing head for a variation of the cap (state where the tip end of the seal lip is in contact with the nozzle surface).

The capping method that uses this cap 30 to cap the printing head will be explained using FIGS. 12A and 12B. The printing head 40 and cap 30 are brought close to each other from a state in which the cap 30 faces the nozzle surface 41 of the printing head 40, and first the tip end of the partitioning lip 32 comes into contact 6 with the nozzle surface 41 (see FIG. 12A).

By doing this, only a nozzle group (not shown in the figure) that is located on the nozzle surface 41 and that sprays a specified ink is covered by the partitioning lip 32. The cap 30 is then brought even closer to the printing head 40 so that the tip end of the seal lip 31 comes in contact with the nozzle surface 41, and the seal lip 31 covers all of the nozzle groups on the nozzle surface 41 (see FIG. 12B).

When the printing head 40 is capped in this way, inside of the partitioning lips 32, the tip end of the partitioning lip 32 comes in closer contact with the nozzle surface 41 than the tip end of the seal lip 31, and the inside is covered from the outside by both the partitioning lip 32 and seal lip 31, so when capped, the seal inside the partitioning lip 32 is very high, and the ink of the nozzle group that is covered by the partitioning lip 32 is kept in a moist state, so it becomes difficult for ink to become thick due to dryness.

For example, by assuming that the black ink in FIG. 3 dries more easily and becomes thick more easily than the other ink, the two-row nozzle group 14*b* that sprays black ink is covered by the partitioning lip 32, and all of the nozzle groups 14*b*, 14*y*, 14*m* and 14*c* on the nozzle surface are covered by the seal lip 31. By covering ink that becomes thick more easily and has lower resistance to drying than other ink that is sprayed from the nozzle groups by the partitioning lip 32 in this way, capping becomes possible in which the contact load between the seal lip 31 and nozzle surface 41 is suppressed, and together with being able to reduce the cap load when covering the printing head 40 with the cap 30, it is possible to reduce the load on the capped printing head 40.

Also, since the rigidity is lowered by forming the neck section 33 on the partitioning lip 32, it is possible to reduce the contact load between the partitioning lip 32 and the nozzle surface 41, and in doing so it is possible to reduce cap load and further reduce the load on the capped printing head 40. Therefore, particularly; it is possible to effectively store the nozzles when not printing and the printing head is capped for a long period of time without applying a load on the printing head 40 or carriage (not shown in the figure) on which the printing head 40 is mounted.

By covering the nozzle surface 41 with the cap 30 and performing purging, the ink that is discharged inside the partitioning lip 32, and the ink that is discharged between the partitioning lip 32 and seal lip 31, can be discharged separately to the outside of the cap 30 through the ink-discharge ports 34, 35, 36 and collected. The ink-discharge ports 34, 35 are formed at two locations between the partitioning lip 32 and seal lip 31, however, it is possible to discharge the ink through an ink-discharge port that is located at only one location, and to collect the ink.

With the cap 30 of the variation described above, only one ring-shaped partitioning lip 32 is located on the inside of the seal lip 31, however, the invention is not limited to this, and it is possible to have two or more. Also, in the variation described above, the cross-sectional shape of the seal lip 31 and partitioning lip 32 is changed by having a difference in height, however, beside this it is also possible to change the width, or to make one a forked shape.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. An inkjet printer, comprising:

a printing head having a nozzle surface on which a plurality of nozzles are located that spray a plurality of kinds of ink; and a cap that covers said nozzle surface of said printing head;

wherein said cap comprises:

a ring-shaped seal lip that is constructed so that a tip end thereof comes in contact with said nozzle surface to perform capping; and a partitioning lip that partitions the area inside said seal lip into areas for nozzle groups that correspond to the kinds of ink;

wherein the tip end of said seal lip or a tip end of said partitioning lip is shaped so that it is compressed more easily than that of the other;

wherein said partitioning lip is formed in a ring shape inside said seal lip, and a gap is formed between said partitioning lip and said seal lip;

wherein the gap is formed about the entire periphery of the partition lip;

wherein the plurality of nozzles comprises:

first nozzles which are surrounded only by the seal lip; and second nozzles which are surrounded by both the seal lip and the partition lip;

wherein a first chamber is formed in the cap by an inner periphery of the seal lip and an outer periphery of the partition lip, and a second chamber is formed in the cap by an inner periphery of the partition lip; and wherein the first chamber is independent from the second chamber, such that the first chamber does not communicate with the second chamber.

2. The inkjet printer of claim 1;

wherein the tip end of said seal lip is formed in a shape so that it is compressed more easily than that of said partitioning lip.

3. The inkjet printer of claim 1;

wherein the tip end of either said seal lip or said partitioning lip is shaped so that it is thinner than the tip end of the other.

4. An inkjet printer, comprising:

a printing head having a nozzle surface on which a plurality of nozzles are located that spray a plurality of kinds of ink; and a cap that covers said nozzle surface of said printing head;

wherein said cap comprises:

a ring-shaped seal lip that is constructed so that a tip end thereof comes in contact with said nozzle surface to perform capping; and a partitioning lip that partitions the area inside said seal lip into areas for nozzle groups that correspond to the kinds of ink;

wherein the tip end of said seal lip protrudes more than a tip end of said partitioning lip;

wherein said partitioning lip is formed in a ring shape inside said seal lip, and a gap is formed between said partitioning lip and said seal lip;

wherein the gap is formed about the entire periphery of the partition lip;

wherein the plurality of nozzles comprises:

first nozzles which are surrounded only by the seal lip; and second nozzles which are surrounded by both the seal lip and the partition lip;

wherein a first chamber is formed in the cap by an inner periphery of the seal lip and an outer periphery of the partition lip, and a second chamber is formed in the cap by an inner periphery of the partition lip; and wherein the first chamber is independent from the second chamber, such that the first chamber does not communicate with the second chamber.

5. The inkjet printer of claim 4;

wherein a depression is formed in the portion of said nozzle surface where the tip end of said seal lip comes in contact.

6. The inkjet printer of claim 4;

wherein the tip end of said seal lip is formed in a shape so that it is compressed more easily than that of said partitioning lip.

7. The inkjet printer of claim 4;

wherein the tip end of either said seal lip or said partitioning lip is shaped so that it is thinner than the tip end of the other.

8. An inkjet printer, comprising:

a printing head having a nozzle surface on which a plurality of nozzles are located that spray a plurality of kinds of ink; and a cap that covers said nozzle surface of said printing head;

wherein said cap comprises:

a ring-shaped seal lip that is constructed so that a tip end thereof comes in contact with said nozzle surface and covers all of the plurality of nozzles; and a partitioning lip that is located inside said seal lip, and can separate nozzle groups that spray specified kinds of ink, and cover the nozzle groups;

wherein the cross-sectional shapes of said seal lip and said partitioning lip differ so that the loads that said nozzle surface receives from said seal lip and said partitioning lip differ when capped;

wherein said partitioning lip is formed in a ring shape inside said seal lip, and a gap is formed between said partitioning lip and said seal lip;

wherein the gap is formed about the entire periphery of the partition lip;

wherein the plurality of nozzles comprises:

first nozzles which are surrounded only by the seal lip; and second nozzles which are surrounded by both the seal lip and the partition lip;

wherein a first chamber is formed in the cap by an inner periphery of the seal lip and an outer periphery of the partition lip, and a second chamber is formed in the cap by an inner periphery of the partition lip; and wherein the first chamber is independent from the second chamber, such that the first chamber does not communicate with the second chamber.

9. The inkjet printer of claim 8;

wherein a tip end of said partitioning lip protrudes more than the tip end of said seal lip.

10. The inkjet printer of claim 9;

wherein the nozzle group that is covered by said partitioning lip when capped, is a nozzle group that sprays ink that thickens more easily than other ink.

11. The inkjet printer of claim 9;

wherein an ink-discharge port is located in at least one location in both the inside of said partitioning lip and between said partitioning lip and said seal lip.

12. The inkjet printer of claim 9;

wherein said partitioning lip has lower rigidity than said seal lip.

13. The inkjet printer of claim 12;

wherein a thin neck section is formed on said partitioning lip.

14. A capping method for capping a printing head in which a cap covers a nozzle surface of a printing head on which a plurality of nozzles that spray a plurality of kinds of ink are located, comprising the steps of:

moving said printing head to the position where said cap is located so that said printing head faces said cap;

moving said cap toward said printing head;

stopping movement of said cap when a tip end of a ring-shaped seal lip, which is formed in said cap, and a tip end of a partitioning lip, which partitions the inside of said seal lip for each kind of ink, come in contact with said nozzle surface when sucking ink from inside of the nozzles;

stopping the movement of said cap in a state where the tip end of said seal lip comes in contact with said nozzle surface, and the tip end of said partitioning lip does not come in contact with said nozzle surface, when storing the nozzles when not printing; and maintaining said cap in this stopped position.

15. A capping method for capping a printing head when not printing in which a cap covers a nozzle surface of a printing head on which a plurality of nozzles that spray a plurality of kinds of ink are located, comprising the steps of:

bringing a tip end of a ring-shaped partitioning lip that is located in said cap in contact with said nozzle surface, and covering a nozzle group that sprays an ink that becomes thicker more easily than other ink that is sprayed from the other nozzle groups with said partitioning lip; and bringing a tip end of a ring-shaped seal lip that is located around said partitioning lip in contact with said nozzle surface and covering all of the plurality of nozzles with said seal lip;

wherein said partitioning lip is formed in a ring shape inside said seal lip, and a gap is formed between said partitioning lip and said seal lip;

wherein the gap is formed about the entire periphery of the partition lip;

wherein the plurality of nozzles comprises:

first nozzles which are surrounded only by the seal lip; and second nozzles which are surrounded by both the seal lip and the partition lip;

wherein a first chamber is formed in the cap by an inner periphery of the seal lip and an outer periphery of the partition lip, and a second chamber is formed in the cap by an inner periphery of the partition lip; and wherein the first chamber is independent from the second chamber, such that the first chamber does not communicate with the second chamber.

* * * * *